US005337879A

United States Patent [19]

Fischer

[11] Patent Number: 5,337,879

[45] Date of Patent: Aug. 16, 1994

[54] TREAD ELEMENT FOR MOVING PAVEMENT OR ESCALATOR

[75] Inventor: Moritz Fischer, Engelberg, Switzerland

[73] Assignee: Inventio AG, Hergiswil, Switzerland

[21] Appl. No.: 995,322

[22] Filed: Dec. 22, 1992

Related U.S. Application Data

[63] Continuation of Ser. No. 876,895, Apr. 29, 1992, abandoned, which is a continuation of Ser. No. 759,935, Sep. 16, 1991, abandoned, which is a continuation of Ser. No. 240,084, Sep. 2, 1988, abandoned, which is a continuation-in-part of Ser. No. 767,604, Aug. 20, 1985, abandoned.

[30] Foreign Application Priority Data

Aug. 21, 1984 [CH] Switzerland ..... 3995/84

[51] Int. Cl.[5] ..... B66B 23/12

[52] U.S. Cl. ..... 198/333

[58] Field of Search ..... 198/324, 325, 333; 52/177, 179

[56] References Cited

U.S. PATENT DOCUMENTS

| | | | |
|---|---|---|---|
| 3,334,456 | 8/1967 | Naka | 52/179 X |
| 3,861,592 | 1/1975 | Fisher | 52/177 X |
| 4,295,556 | 10/1981 | Saito et al. . | |
| 4,321,293 | 3/1982 | Naka | 52/179 X |
| 4,321,294 | 3/1982 | Naka | 52/179 X |
| 4,362,232 | 12/1982 | Saito et al. . | |
| 4,413,719 | 11/1983 | White . | |
| 4,570,781 | 2/1986 | Kappenhagen . | |

FOREIGN PATENT DOCUMENTS

| | | | |
|---|---|---|---|
| 2161442 | 7/1972 | Fed. Rep. of Germany | 198/333 |
| 0041378 | 3/1977 | Japan | 198/333 |
| 0041379 | 3/1977 | Japan | 198/333 |
| 0124885 | 10/1978 | Japan | 198/333 |
| 0131287 | 10/1979 | Japan | 198/333 |
| 0753766 | 8/1980 | U.S.S.R. | 198/333 |
| 0954345 | 9/1982 | U.S.S.R. | 198/333 |

*Primary Examiner*—James R. Bidwell
*Attorney, Agent, or Firm*—Watts, Hoffmann, Fisher & Heinke Co.

[57] ABSTRACT

A tread element for a moving pavement or an escalator has a tread plate adapted to receive the person to be transported. The tread plate has a nosing secured to it along at least one of its longitudinal edges. In one embodiment, the nosing is secured to the tread plate by a longitudinal hook engaging the underside of the tread plate, a plurality of plugs passing through slots in the tread plate and secured underneath by stops such as a clamp-ring, and a plurality of centering projections which engage under a portion of the tread plate along the upper surface. The compact step is a single die-casting, which does not have to be completely removed and replaced in the event of breakage of the tread plate ribbing in the outer zone of the tread plate.

25 Claims, 12 Drawing Sheets

TREAD ELEMENT FOR MOVING PAVEMENT OR ESCALATOR

RELATED APPLICATIONS

The present application is a continuation of Ser. No. 07/876,895 filed Apr. 29, 1992 which was a continuation of Ser. No. 07/759,935 filed Sep. 16, 1991 which was a continuation of Ser. No. 07/240,084 filed Sep. 2, 1988 which was a continuation-in-part of co-pending application Ser. No. 06/767,604 filed Aug. 20, 1985, all now abandoned.

TECHNICAL FIELD

The present invention relates to moving pavements or escalators, and more particularly to a nosing positioned near an edge of a tread plate on a tread element.

As used in this application, the term "movable tread element" should be taken to mean a tread element adapted for use in a "people mover" which is either an escalator or moving pavement, the distinction being that a moving pavement moves roughly parallel to the ground while an escalator carries people or property up or down an incline.

BACKGROUND ART

Tread elements having external nosings and moldings or the like are known. Unfortunately, securing them by means of a few screws to the tread element is inadequate in the long term for the rough operating conditions to which they are subjected, and breakages of nosings or the jamming of nosings between relatively moving parts of a moving pavement or an escalator cause unwanted disturbances in operation.

It is known to use so-called compact tread elements, i.e., unitary die cast tread elements typically made of aluminum alloys. These are stronger and lighter than composite tread elements but have the disadvantage of requiring replacement of the entire tread element in the event of damage to the ribbing on the outside edges of the tread surface which is a relatively elaborate and expensive operation.

DISCLOSURE OF THE INVENTION

It is one object of the invention to provide a tread element which is free from these disadvantages and which enables a nosing or the like to be secured over the entire length of at least one of its longitudinal edges.

According to the invention, therefore, an improved nosing engages in a channel in the tread plate by means of a longitudinal extension from one of its two longitudinal edges. In addition, the nosing is preferably rigidly secured to the tread plate by additional securing means. The channel may be positioned either on an upper surface of the tread plate or one of the horizontal faces, and may be recessed into the tread plate either horizontally or vertically.

More specifically, a preferred nosing includes an elongated top portion, a longitudinal extension projecting from the top portion for engagement with a channel in the tread plate, an apron projecting from the top portion remote from the longitudinal extension, and another longitudinal extension projecting at an angle from the apron either for engagement with another channel on the tread plate or for hooking under the lower surface of the plate.

In one preferred embodiment of the nosing, both the first and second longitudinal extensions project from the top portion and apron at an angle. The first extension fits into a channel recessed in the upper surface of the tread plate and the second extension fits into a channel on a horizontal surface of the tread plate. This style of nosing is most expedient for use on the front edge of the tread plate.

Conveniently, an alternate embodiment is provided to ensure that nosings secured laterally and at the rear to the tread plate do not drop off in the event of accidental release of their additional securing means while the element is in use. To this end, a lateral gap is provided between the nosing and a component immediately adjacent the nosing. The component is disposed at the same height as or projecting beyond the nosing and is selectively movable relatively to the tread plate to permit the nosing to be shifted longitudinally for removal from the tread plate.

Conveniently too, for an optimal connection between the nosing or the like and the tread element, the interengaging parts of the nosing and the tread plate form two longitudinal guides which extend along the two longitudinal edges of the nosing and which permit longitudinal movement thereof relatively to the tread plate but prevent movement transversely of nosing length.

Advantageously, to ensure that in the event of the additional securing means being lost a nosing disposed laterally on the tread plate cannot accidentally drop off, the nosing extending along the tread element front wall extends over the entire width of the tread plate and therefore prevents the two lateral nosings from projecting out in their guides beyond the front wall.

Conveniently, at least one of the two lateral nosings extends to the tread element front wall and has an abutment which cooperates with the tread plate and which permits introduction of the nosing from the tread plate side opposite the front wall into its associated longitudinal guide but prevents movement of the nosing in such guide beyond the front wall.

In one embodiment of the tread element, the nosing is secured to the tread element through securing plugs which engage slots in the tread plate and a hook portion on the outer longitudinal edge of the nosing. Centering and holding ribs disposed near the securing plugs help position the nosing on the tread plate. Stops, such as clamp-rings, may be engaged with the plugs to further secure the nosing. The nosing may be provided with an oblique inner longitudinal edge portion for further engagement with the tread plate. In one specific embodiment, the nosing also includes a centering projection which cooperates with the other elements to position the nosing on the tread plate.

An alternative to this embodiment omits the centering and holding ribs. The centering projection has a hook portion which engages a recess in the tread plate to position and secure the nosing.

In yet another embodiment of the tread element, nosings are mounted on the curved side edges of the tread element in the same manner as on the tread plate.

The invention also relates to a tread element for a moving pavement or escalator, the tread element having a tread plate to receive the person to be transported, the tread element having a warning strip extending along an outside of the tread plate, characterized in that the warning strip is a differently colored nosing which is inserted in the tread plate, is at a distance from the outside thereof, forms part of the tread plate tread surface and is rigidly attached to the tread plate by additional securing means.

The invention will be described further below, by way of example, with reference to the accompanying drawings, wherein:

BRIEF DESCRIPTION OF THE DRAWINGS

FIG. 14 is a view in cross section of another exemplary embodiment for securing a nosing or edge strip or the like;

BEST MODE FOR CARRYING OUT THE INVENTION

Figure 1:
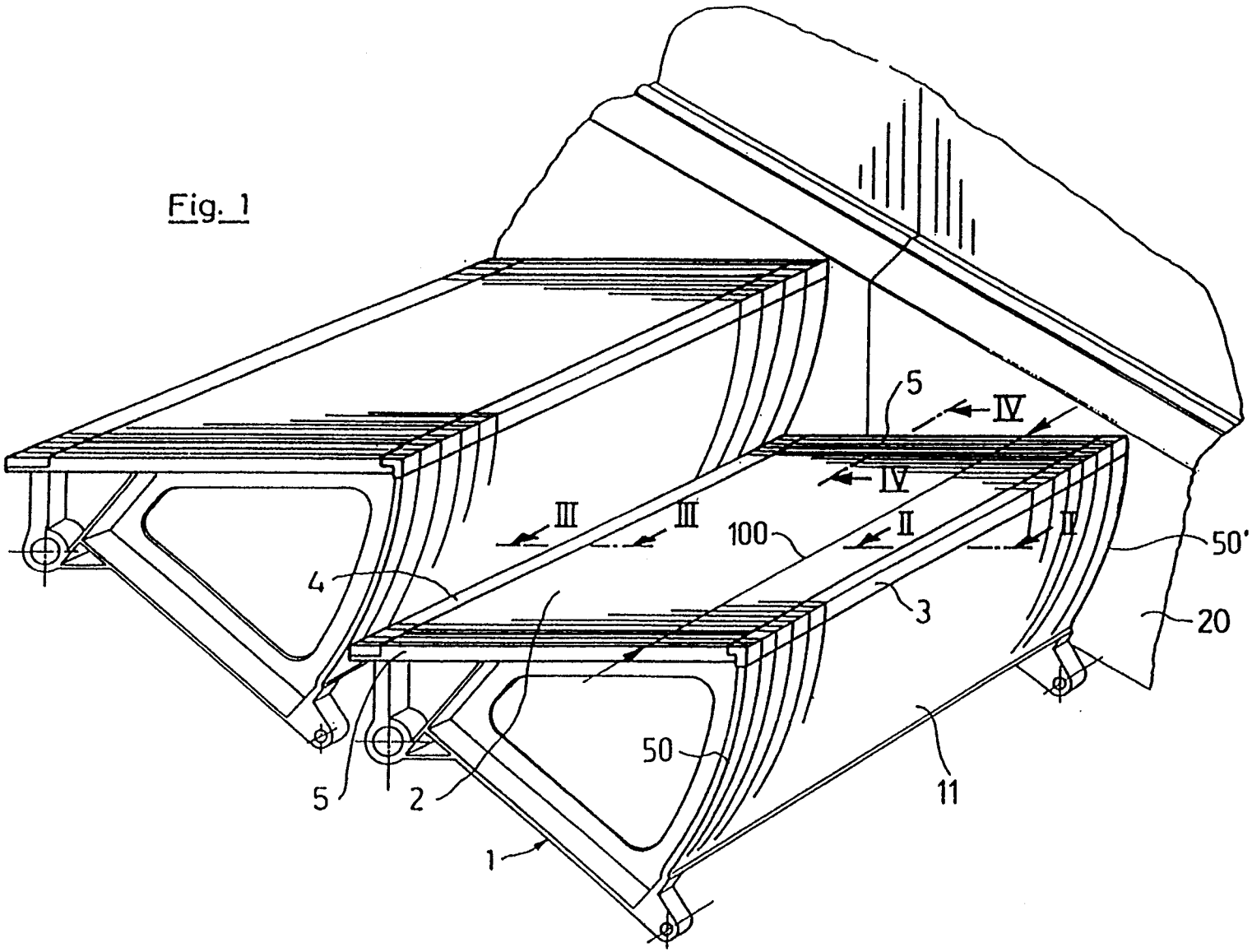
FIG. 1 is a perspective view of a part of an escalator having tread elements in accordance with the invention.

As can be gathered from FIG. 1, a tread element or escalator step i of the escalator shown has a tread plate 2 with an upper passenger support surface adapted to receive the person to be transported. The tread plate 2 has nosings or edge strips 3, 4, 5 introduced into it and secured to it. Each of the nosings has an upper support surface aligned with and forming an extension of the passenger support surface.

Figure 2:
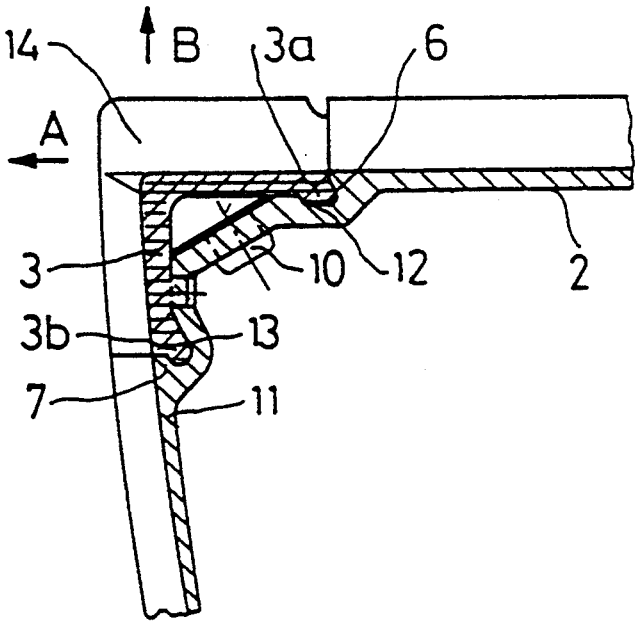
FIG. 2 is a fragmentary cross sectional view on the line II—II of FIG. 1.
Figure 4:
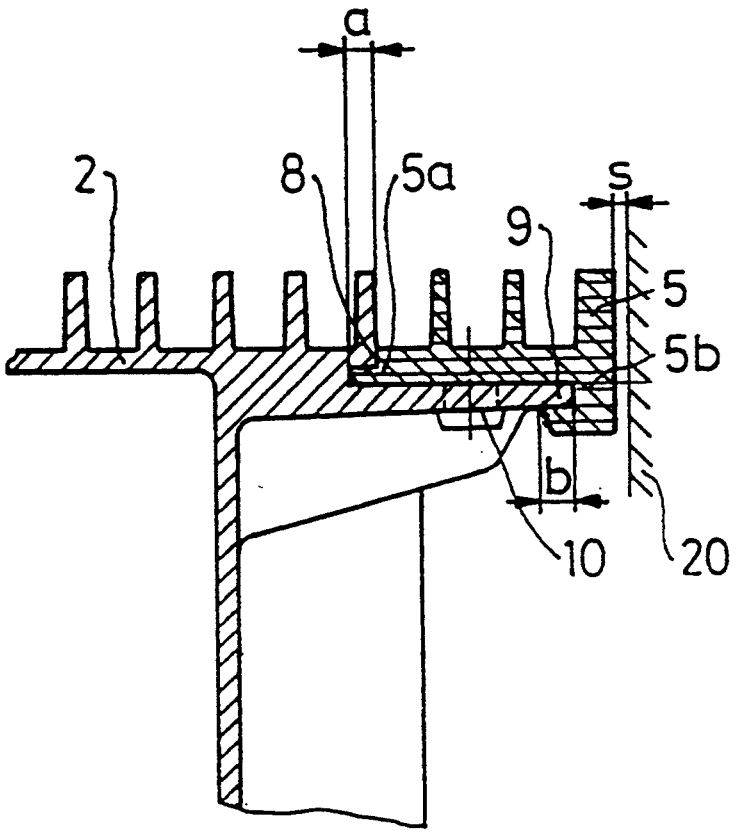
FIG. 4 is a fragmentary cross sectional view on the line IV—IV of FIG. 1.

As can be gathered from FIGS. 2 and 4, the relatively heavily exposed nosings 3 and 5 respectively engage the step 1 along spaced longitudinal edges 3*a*, 3*b* and 5*a*, 5*b* over their respective entire lengths. The nosing 3 is secured at the edge 3*a* under a projection 6 of the step 1 and at the edge 3*b* under a projection 7 of the step 1. The nosing 5 is secured at the edge 5*a* under a projection 8 of step 1 and at the edge 5*b* under an outside edge 9 of the step 1 which the hook-like edge 5*b* embraces. Also, securing elements in the form of screws 10 are provided which rigidly secure the nosings 3, 5 to the tread plate 2 between their two longitudinal edges 3*a*, 3*b* and 5*a*, 5*b* and are respectively retained by the tread plate 2.

As FIG. 2 shows, the front nosings 3 are formed such that they embrace angularly the front longitudinal edge of the tread plate 2—i.e., of the step 1—and engage along both their longitudinal edges 3*a*, 3*b* in a recess of the step 1 formed below a projection 6, 7. Also, the two longitudinal edges 3*a*, 3*b* of the angular cross-section nosings 3 project at an angle to the tread plate 2 and front wall 11 and engage in corresponding grooves 12, 13 in the step 1. The nosing 3 is therefore prevented from moving in the direction A or B perpendicular to its correspondingly devised longitudinal edge 3*a* and 3*b* parallel to the tread plate 2 and the front wall 11, respectively.

The nosing 3 has, on its outside, ribs 14 of the same pitch as the ribs of the tread plate 2 and the front wall 11.

As can be gathered from FIG. 4, the lateral nosings or edgings 5 engage, along their longitudinal edge 5*a* directed towards the interior of the tread plate 2, in a recess with which part of the tread plate 2 is formed below the projection 8 and are thus secured over the whole length of the edge 5*a* to the step 1.

Along each longitudinal edge 5*b* which extends along the associated outside edge 9 of the tread plate 2, the nosings 5 extend below the outside edge of the tread plate 2 and are therefore secured along the entire lengths of their respective second longitudinal edges 5*b* to the step 1.

Those parts of the nosings 5 which engage below the associated projection 8 and the outside edge 9 are of a length such that their engagement lengths a and b respectively are greater than the lateral gaps s between the nosings 5 and the fixedly disposed side curtaining 20 (see also FIG. 1), so that even should the additional securing elements 10 drop out, the nosing 5 would not drop out as well.

Figure 3:
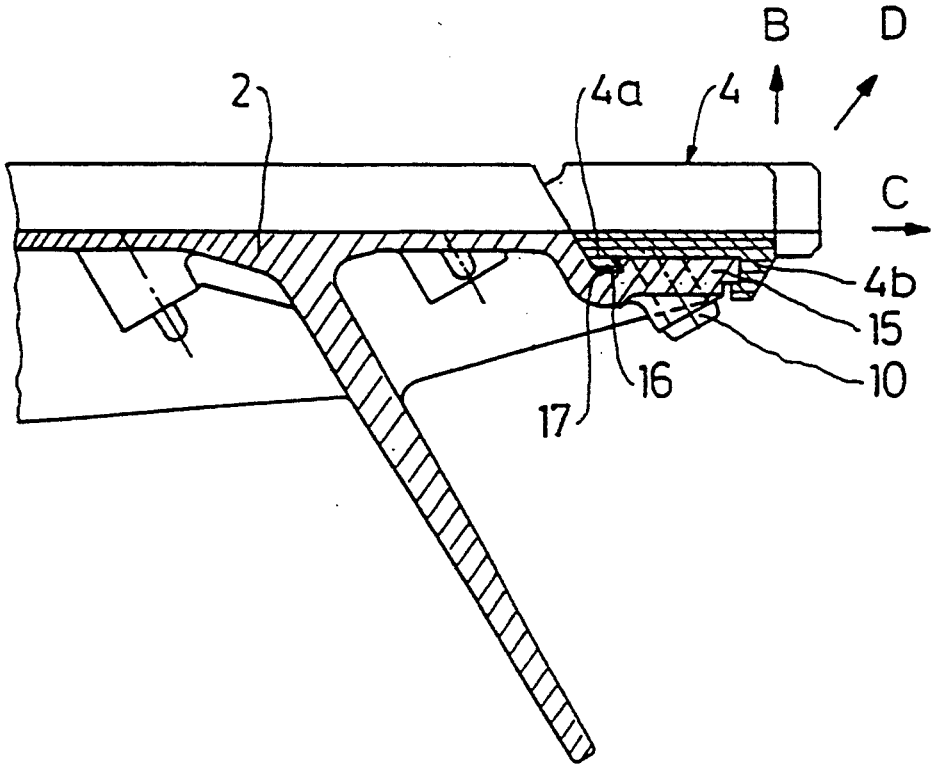
FIG. 3 is a fragmentary cross sectional view on the line III—III of FIG. 1.

As can be gathered from FIG. 3, the rear nosing or edging 4 engages, along its longitudinal edge 4*b*, outside edge 15 of the tread plate 2, below the outside edge thereof. Thus, the rear nosing is secured over the whole length of the edge 4*b* to the tread plate 2.

Along its second longitudinal edge 4a the rear nosing or edging 4 is rigidly secured to the tread plate 2 by the screw 10.

Also, the longitudinal edge 4a of the nosing 4 projects substantially perpendicularly to the tread plate 2 and engages below the tread plate. The resulting catch rib 16 engages in a corresponding inclined groove 17 in the step 1 so that the nosing 4 is prevented from a movement C perpendicular to its correspondingly devised longitudinal edge 4a and parallel to the tread plate 2 or in any other direction extending in such plane over its whole length; consequently, the nosing 4 can be introduced into its two lateral longitudinal guides only lengthwise of itself.

Figure 5:
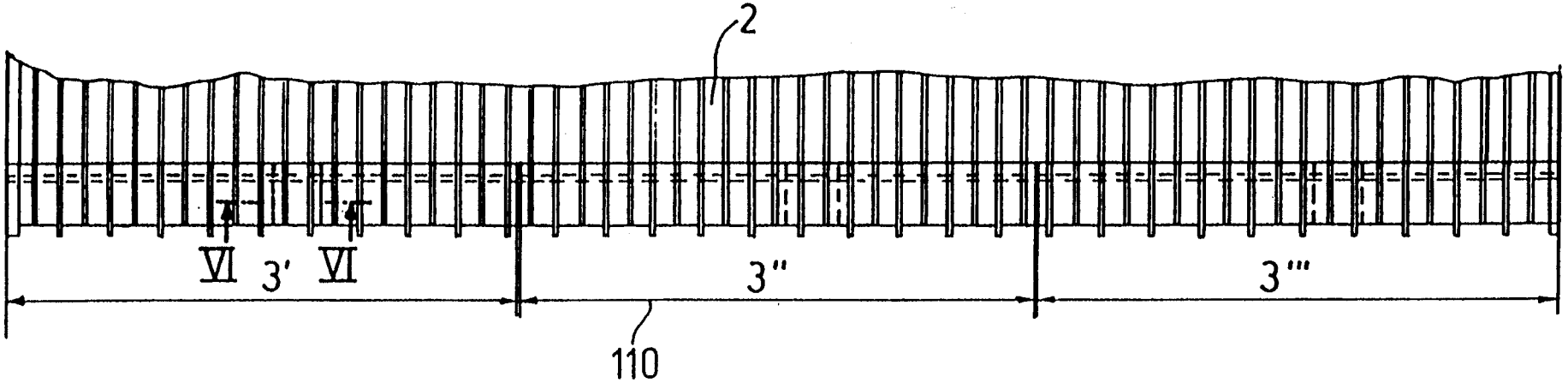
FIG. 5 is a plan view of a part of the tread plate of the escalator step shown in FIG. 1.
Figure 6:
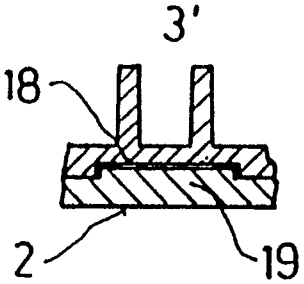
FIG. 6 is a fragmentary sectional view on the line VI—VI of FIG. 5.
Figure 7:
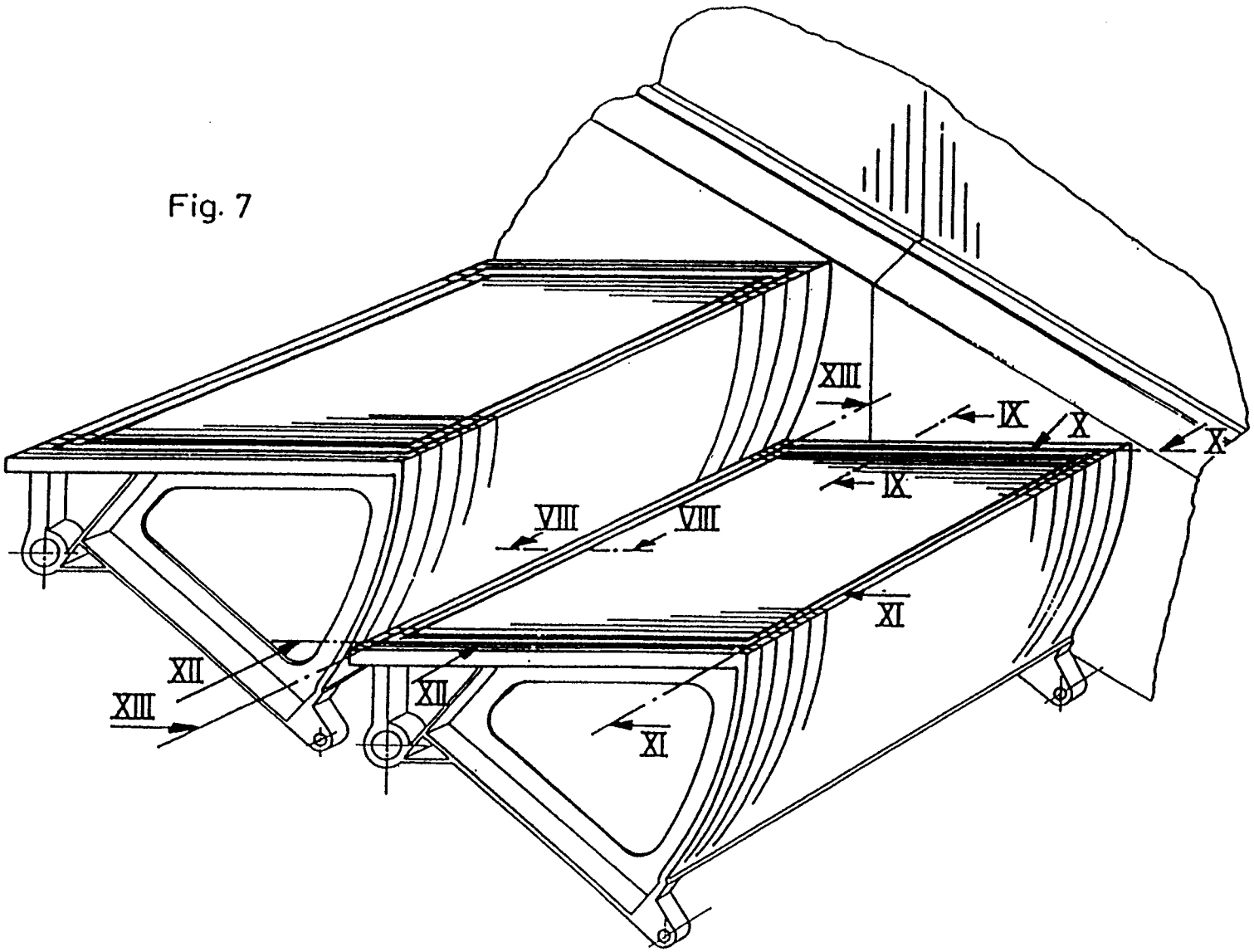
FIG. 7 is a perspective view of a part of a second exemplary embodiment of an escalator having tread elements in accordance with the invention.
Figure 8:
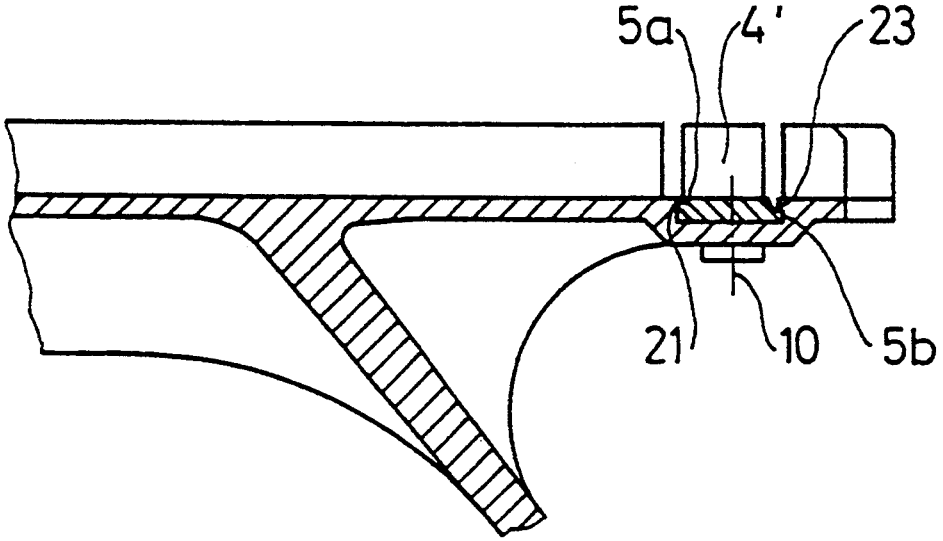
FIG. 8 is a fragmentary cross sectional view on the line VIII—VIII of FIG. 7.
Figure 9:
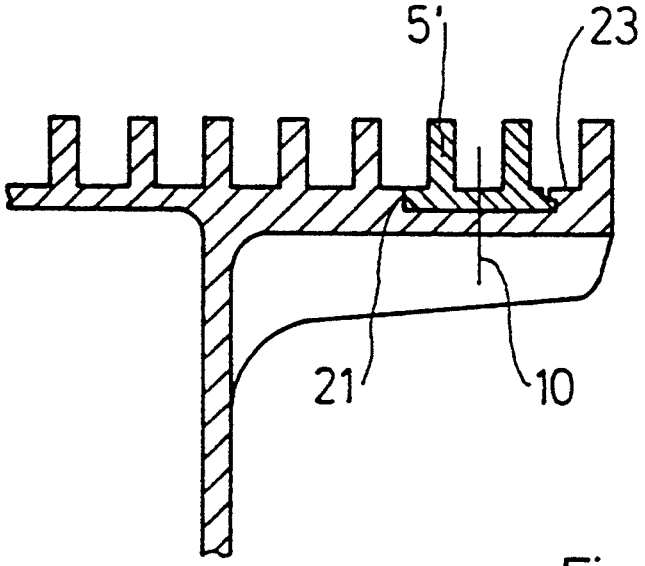
FIG. 9 is a fragmentary cross sectional view on the line IX—IX of FIG. 7.
Figure 10:
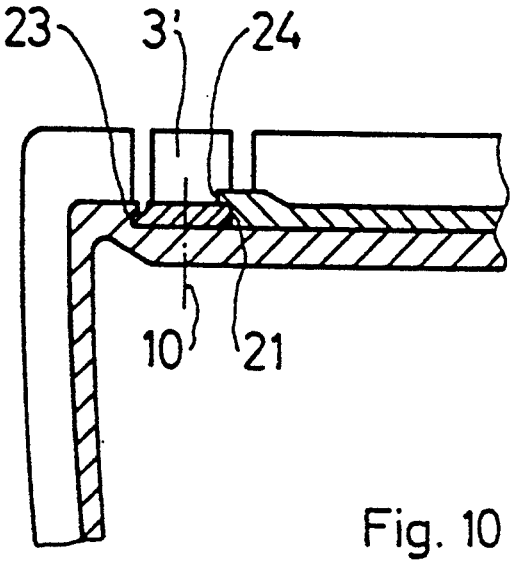
FIG. 10 is a fragmentary cross sectional view on the line X—X of FIG. 7.
Figure 11:
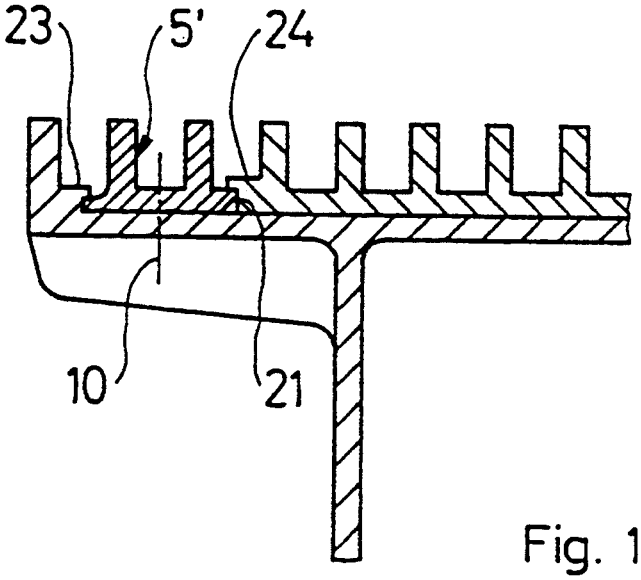
FIG. 11 is a fragmentary cross sectional view on the line XI—XI of FIG. 7.
Figure 12:
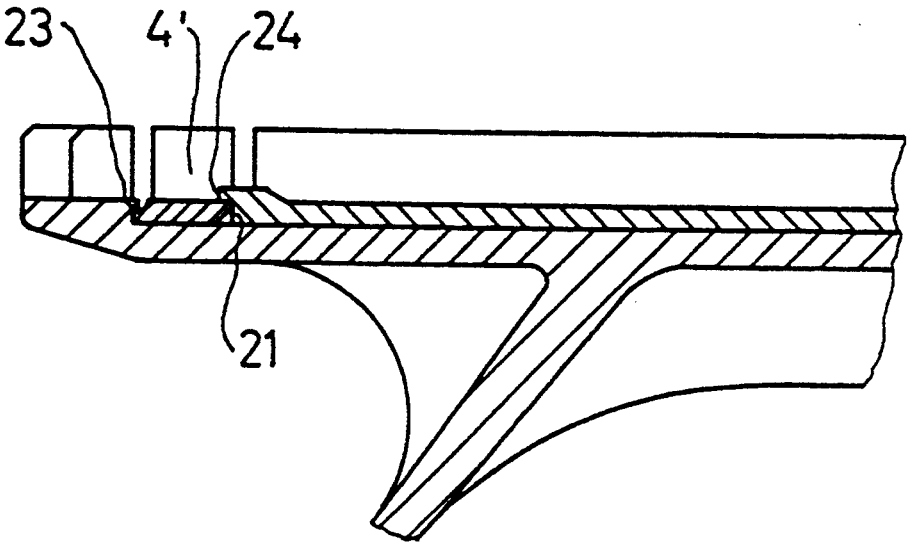
FIG. 12 is a fragmentary cross sectional view on the line XII—XII of FIG. 7.

To reduce the cost of nosing production and to reduce to a minimum the effect of pitch errors of the ribs on the nosings and to reduce very considerably the effect of expansion errors, the nosings are, conveniently, and as shown in FIG. 5, sub-divided over their length into a number of segments 3', 3'', 3'''. The segments 3', 3'', 3''' are formed for lateral centering, in the manner visible in FIG. 6, each with a recess 18 which is in its underside and in which respective centering projections 19 of the step 1 engage centeringly. Of course this kind of centering is possible only in the case of such nosings or the like as do not have to be introduced lengthwise in lateral guides.

Since this kind of anchorage of the nosings 3, 4, 5 to the step 1 calls for a relatively complicated anchorage zone therein, this construction is particularly suitable for compact tread elements produced as an aluminum alloy die casting, where anchorage facilities of this kind can be provided relatively simply.

Of course, securing elements other than the screws 10 can be used, such as plastic anchorage pins which are formed on the nosings or the like and which, after their introduction into correspondingly pre-shaped bores in the tread element, are deformed at the end projecting from the bore by heat and, therefore, anchored.

It is possible to secure on the same manner curved nosings 50, 50' according to the invention at the curved side edges of the curved front wall 11 as shown in FIG. 1.

Figure 15:
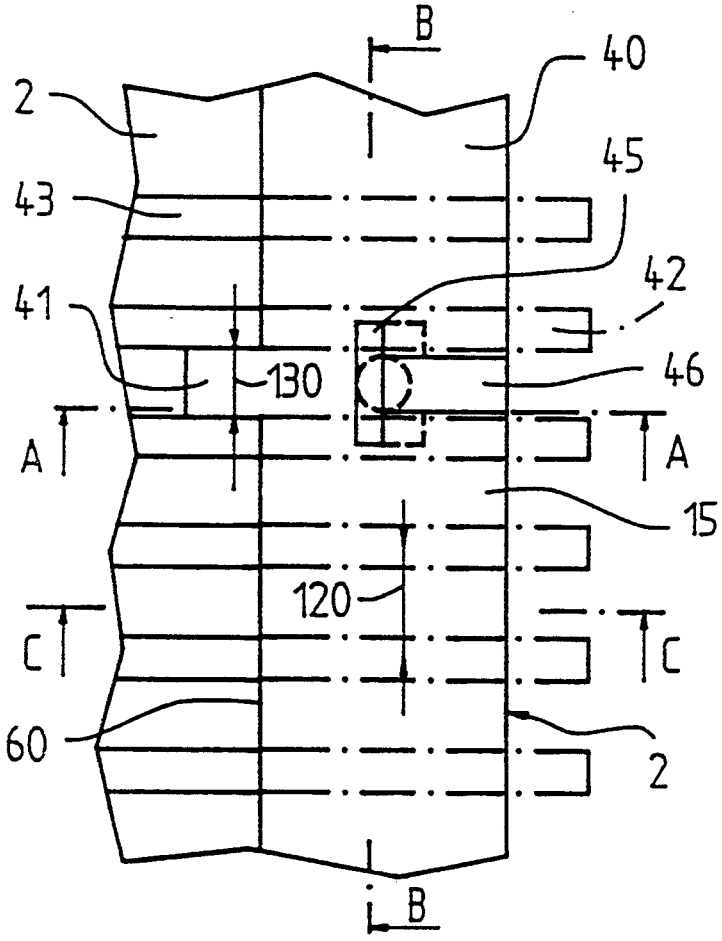
FIG. 15 is a fragmentary top view of the tread plate illustrating an alternative embodiment of the tread element.

FIGS. 15–26 illustrate another embodiment of the tread element, with nosings which are easily installed while secure against falling off even when all nosing securing means are lost due to vibration or other causes. More specifically, FIG. 15 shows the front portion of a tread plate 2 on which a front nosing 40 is mounted. (The position of the front nosing 40 as illustrated in FIG. 15 would correspond with the position of front nosing 3 in FIG. 1.)

The nosing 40 is made of substantially rigid, but slightly resilient, plastic and is provided with ribs 42 of the same pitch as the 43 of the tread plate 2. The nosing 40 is secured to the tread plate 2 by means of a plurality of securing plugs 47 and a plurality of discrete centering and holding ribs 44 each adjacent one of the securing plugs 47. Furthermore, a hook 51 is provided at the lowermost end of the outer longitudinal edge portion 4b to secure the nosing 40 at the front. In the specific embodiment shown in FIG. 15, a centering projection 41 projects from an inner longitudinal edge 49 to center the ribs 42 of the nosing 40 against the ribs 43 of the tread plate 2.

As best shown in FIG. 15, the preferred longitudinal width of the centering projection 41 (shown schematically along line 130) is less than the pitch of the adjacent ribs 42 on the surface of the nosing 40 (shown schematically along the line 120). This in turn implies that the preferred longitudinal width of the centering projection 41 is less than the longitudinal length of a unitary nosing (measured parallel to the line 100 shown in FIG. 1). Likewise, in the case of a nosing 40 divided longitudinally into sections, the preferred longitudinal width of the centering projection 41 would be less than the longitudinal width of a section (measured parallel to the line 110 shown in FIG. 5).

Figure 16:
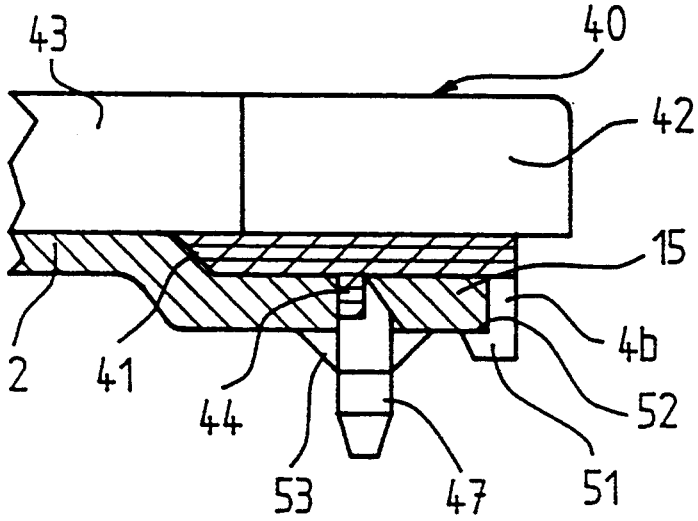
FIG. 16 is a fragmentary cross sectional view on the line A—A of FIG. 15.
Figure 17:
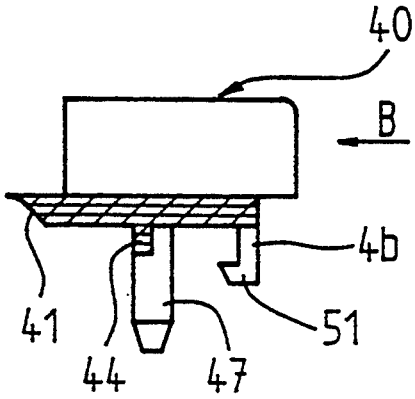
FIG. 17 is a fragmentary side cross sectional view of the nosing separated from the tread plate.
Figure 18:
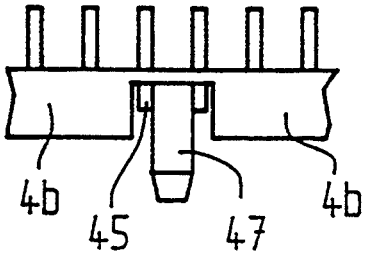
FIG. 18 is a fragmentary cross sectional view on the line B—B of FIG. 15.

As shown best in FIGS. 15 and 16, the tread plate 2 has slots 45 and 46 corresponding to each of the plurality of the securing plugs 47. FIG. 15 indicates that the rectangular slots 46 extend perpendicularly from the outer longitudinal edge of the tread plate 2 into the tread plate and that slots 45 extend out in opposite directions from the inner end of each slot 46. When the nosing 40 is mounted, the slots 45 engage the centering and holding ribs 44 while the slots 46 engage the securing plugs 47.

Figure 19:
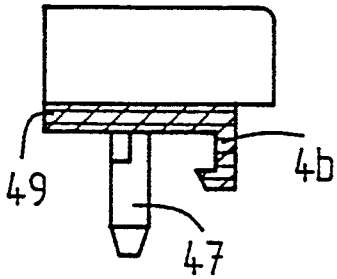
FIG. 19 is a fragmentary cross sectional view on the line C—C of FIG. 15 showing a nosing with a flat inner longitudinal edge.
Figure 20:
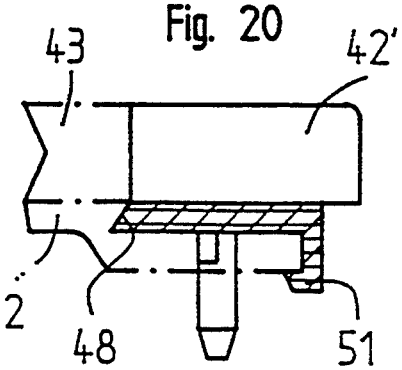
FIG. 20 is a fragmentary cross sectional view on the line C—C of FIG. 15 showing a nosing having an oblique inner longitudinal edge portion.

FIGS. 19 and 20 illustrate alternative configurations for the inner longitudinal edge portion of the nosing 40. The nosing 40 is provided with an oblique inner longitudinal edge 48, FIG. 20 which engages below a portion of the tread plate 2 to rigidly secure the inner longitudinal edge of the nosing 40.

The nosing 40 is mounted by tilting it while its inner longitudinal edge 49 (or, alternatively, the oblique inner longitudinal edge portion 48 of the nosing 40) contacts abutment 60 of the tread plate 2. As the nosing 40 is returned to horizontal, the securing plugs 47 engage the slots 46 and a hook 51 resiliently engages the underside 52 of the outer longitudinal edge 15 of the tread plate 2. Once the nosing 40 is mounted on the tread plate 2, the nosing is securely fixed, particularly against horizontal movement. For additional security, however, clamp-rings 53 are clamped onto the securing plugs 47 to abut the underside of tread plate 2 and act as a stop to prevent the securing plugs 47 from moving vertically in the slots 46.

The embodiment of FIG. 15 is advantageous in that, if one or more of the clamp-rings 53 are lost during movement of the escalator or walk, the nosing 40 will remain secured to the tread plate 2.

FIG. 15 indicates that the longitudinal width of the centering projection 41 is less than the longitudinal length of the nosing 40. Similarly, FIGS. 15 and 16 indicate that the longitudinal width of the centering and holding ribs 44 is less than the longitudinal length of the nosing 40.

Figure 22:
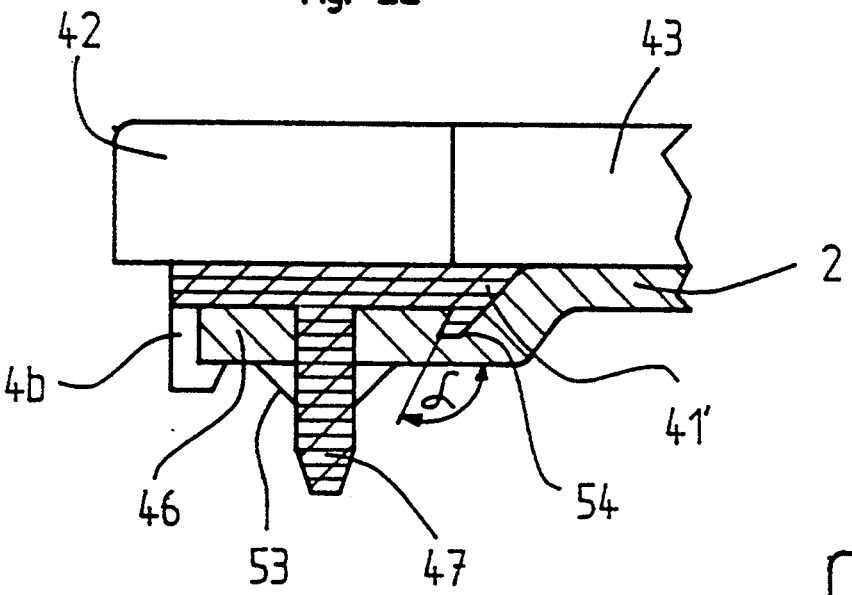
FIG. 22 is a fragmentary cross sectional view along the line A—A of FIG. 21.
Figure 23:
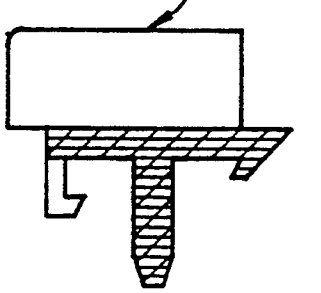
FIG. 23 is a fragmentary side cross sectional view of the nosing separated from the tread plate.
Figure 21:
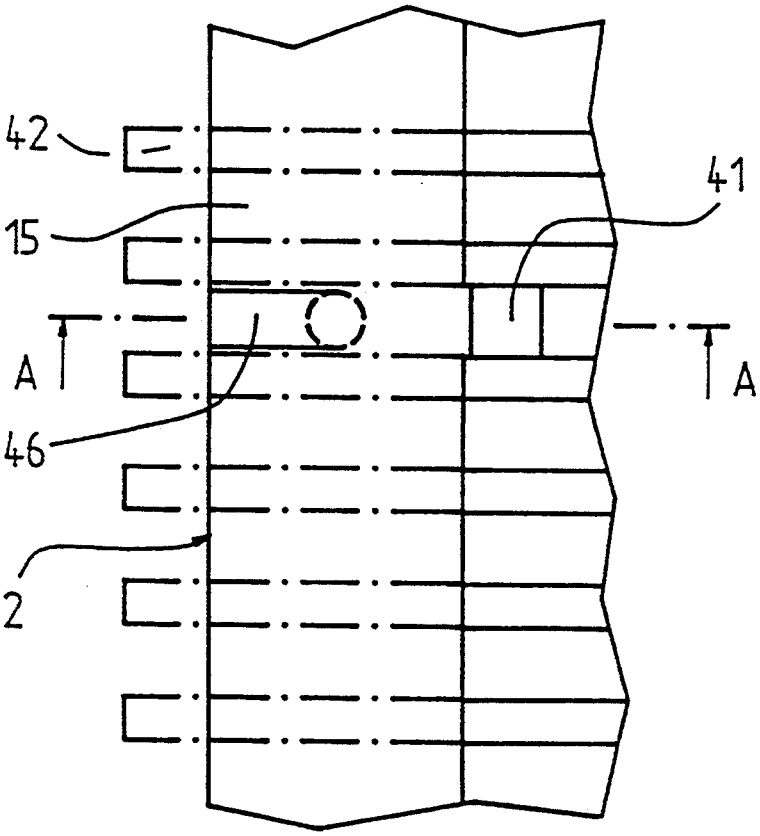
FIG. 21 is a fragmentary top view of the tread plate illustrating another alternative embodiment of the tread element.
Figure 25:
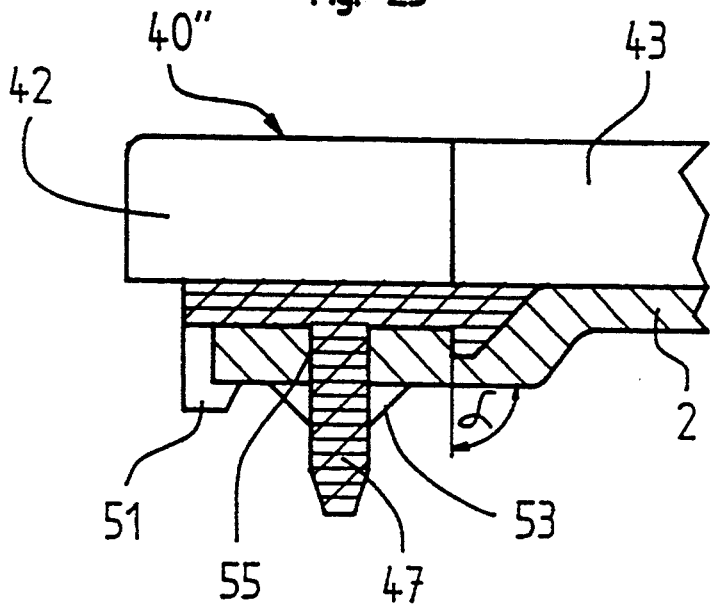
FIG. 25 is a fragmentary cross sectional view along the line A—A of FIG. 24.
Figure 26:
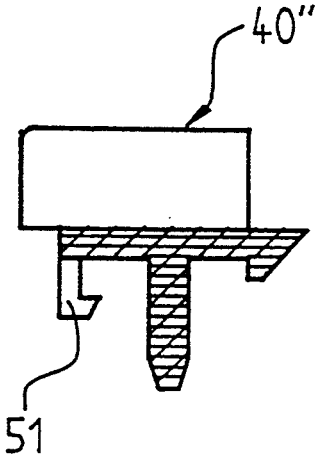
FIG. 26 is a fragmentary cross side sectional view of the nosing separated from the tread plate.
Figure 24:
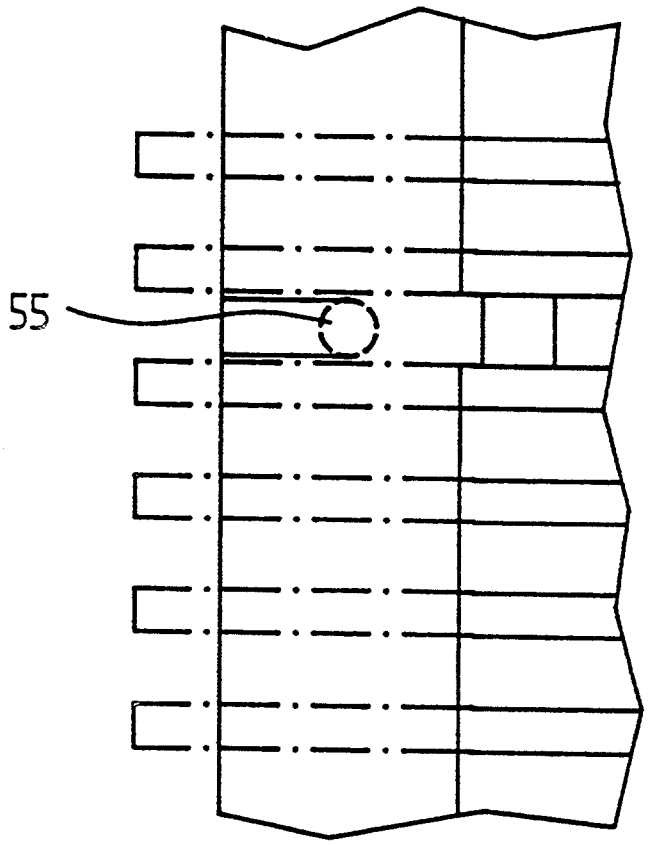
FIG. 24 is a fragmentary top view of the tread plate illustrating an alternative embodiment of the tread element similar to that of FIG. 21.

FIG. 21 shows another embodiment of the tread element with a nosing similar to that of FIGS. 15 and 16 but without holding and centering ribs 44. As indicated in FIG. 21, the back wall of slot 46 in this embodiment is semicylindrical. Instead, the centering projection 41' is provided with a hook 54 which engages in a recess on the upper side of the tread plate 2. The angle $\alpha$ of the hook 54 may be 90°, as shown in FIG. 25 or greater as shown in FIG. 22.

The nosing may be flat at its inner longitudinal edge as depicted in FIG. 19 or have an oblique inner longitudinal edge portion as in FIG. 20.

Instead of an inserting slot 46 there is provided only a cylindrical opening 55 in which the securing plug 47 fits with a sliding fit. With such a construction the plugs 47 of the nosing 40', 40'' can be inserted into the holes 55, then pushed down until the hook 51 resiliently engages the underside of the tread plate 2. This results in a firm securing of the nosing. Clamp-rings are then clamped onto the plugs 47 to act as stops. Such a mounting is very easy and results in a very reliable securing of the nosings.

The tread plate 2 can of course have in its external zones colored markings to indicate to the person on the escalator that he should if at all possible keep away from these outer zones of the tread plate. Unfortunately, these colored markings have the disadvantage that they very quickly cease to be striking because the color coating wears.

To obviate this and to enable the tread plate outer zones to be produced as a unitary die casting with the remainder of the tread element, the warning strip takes the form, as can be gathered more particularly from FIGS. 8–13, of edge strips 3', 4', 5' inserted in the tread plate 2 and disposed at a distance from its outside wall. The latter nosings form a part of the tread plate tread surface and have the same width pitch as the latter and amplify its ribs continuously to form ribs extending over the entire tread surface. The nosings 3', 4', 5' used for this purpose can be made, for example, of yellow plastic or of a yellow anodized aluminum alloy; in the latter event the nosings can be produced, for example, by drawing or continuous casting.

The edging 3', 4', 5' are secured, as can be gathered from FIGS. 8 to 13, by each engaging along one longitudinal edge **3'*b*, 4'*b*, 5'*b* respectively below a projecting part of the tread plate 2, to be satisfactorily secured thereto over their whole length. To ensure that the nosings 3', 4', 5' cannot shift laterally, opposite longitudinal edges 3'*a*, 4'*a*, 5'*a* engage each with an abutment 21 formed in the tread plate 2. The foot of the nosings or edgings thus engaging in a recess in the plate 2 is so devised that the various nosings can be removed from the tread element if they are first tilted around their longitudinal edge 3'*b*, 4'*b*, 5'*b* disposed below the respective projection 23 of the tread plate 2**.

After the nosings 3', 4', 5' have been introduced into the tread plate 2, the nosings are rigidly secured thereto by means of additional securing means 10, such as screws.

Figure 13:
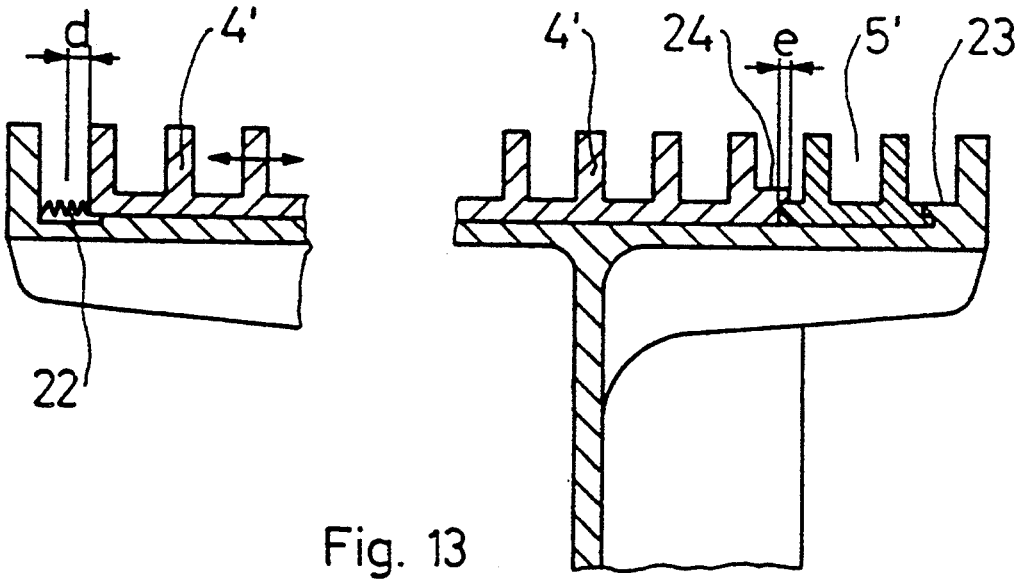
FIG. 13 is a fragmentary cross sectional view on the line XIII—XIII of FIG. 7.

To ensure that in the event of any screws 10 dropping out the nosings 3', 4', 5' cannot drop out, the latter are interlaced by means of overlapping projections 24. However, to enable any of the four nosings to be introduced or removed, the nosing 4' is, as shown in FIG. 13, movable lengthwise by an amount d greater than the overlap e of its projection 24 over the contiguous nosing 5'.

To remove the nosings thus secured from the plate 2, all the screws 10 are first removed, whereafter the rear nosing 4' is disengaged against the force of a compression spring 22 from the nosing 5' it overlaps, whereafter the nosing 5', then the front nosing 3', then the other side nosing 5' and finally the rear nosing 4' can be removed from the tread plate 2. Also, the nosings 3', 4', 5' can be secured by their overlapping arrangement without this additional securing.

Figure 14:
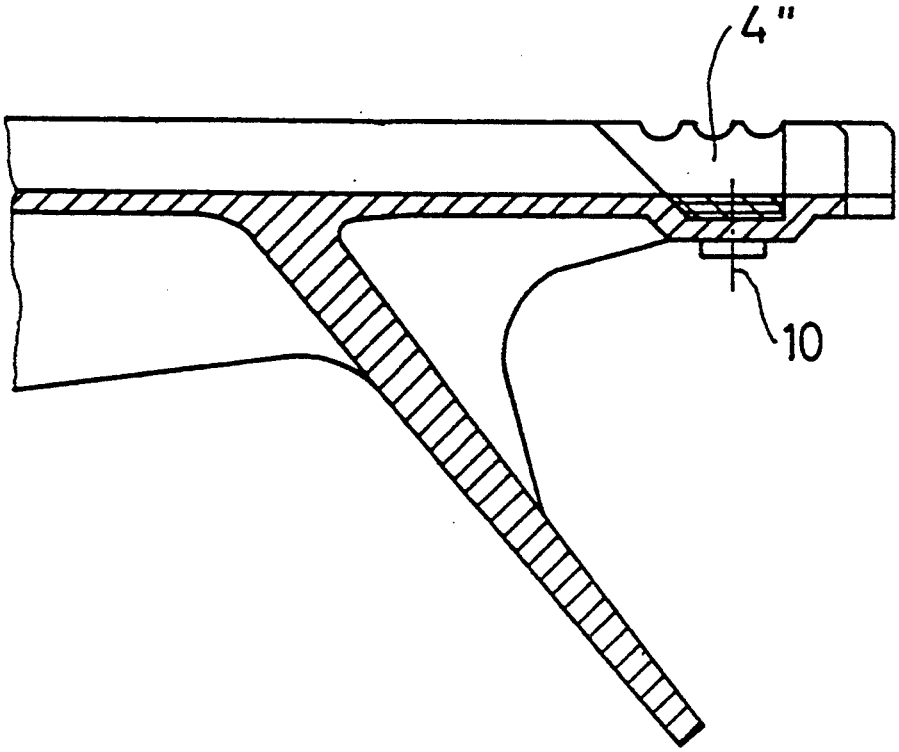

As FIG. 14, shows, nosing 4'' can be introduced in a recess in the tread plate 2, such recess centering the nosing at least laterally and preferably narrowing downwardly.

While examples for carrying out the invention have been described in detail, those familiar with the art to which this invention relates will recognize various alternative embodiments for practicing the invention as defined by the claims.

I claim:

1. In combination, a movable tread element having a tread plate with an upper passenger support surface and a nosing comprising:

a) an outer longitudinal edge portion having a hook at a lower most end for engaging below an outside edge of such tread plate;

b) inner securing portions interlocking with and securing the nosing to the tread plate near an inner longitudinal edge of the nosing;

c) additional securing means between said inner longitudinal edge and outer longitudinal edge portion of the nosing and passing through such tread plate to secure the nosing against movement; and d) said nosing defining an element edge portion having an upper support surface aligned with and forming an extension of said passenger support surface to provide an extension thereof.

2. A tread element according to claim 1 wherein the inner securing means comprises an oblique inner longitudinal edge portion for engagement below a portion of such tread plate.

3. A tread element according to claim 1 wherein the additional securing means comprises a plug for passing through such tread plate so as to secure the nosing against movement.

4. A tread element according to claim 3 wherein the additional securing means comprises a plug which engages a stop on the underside of the tread plate to prevent the plug from moving vertically in the slot.

5. A tread element according to claim 4 wherein a clamp-ring is clamped onto the plug to prevent the plug from moving vertically in the slot.

6. A tread element according to claim 4 wherein the plug is composed of plastic and is deformed by heat at an end adjacent the underside of the tread plate to prevent the plug from moving vertically in the slot.

7. A nosing according to claim 1 wherein the additional securing means comprises a plug and a centering and holding rib adjacent the plug for engagement in a slot on such tread plate so as to secure the nosing against movement.

8. A tread element according to claim 1 wherein the inner securing means engages below a portion of such tread plate.

9. A tread element according to claim 1 wherein the nosing is mounted on an edge of the tread plate near a side curtaining of a conveyor and wherein an engagement length of the hook below the outside edge of the tread plate and an engagement length of the inner securing means are each greater than a length between the edge of the tread plate and the side curtaining.

10. A tread element according to claim 1 wherein the additional securing means comprises a plug and a centering and holding rib adjacent the plug and wherein the tread plate includes at least one centering and holding rib slot extending out from an inner end of the tread plate slot for engagement with the centering and holding rib so as to secure the nosing against movement.

11. A tread element according to claim 1 wherein the tread plate includes at least one tread plate rib and the nosing includes at least one nosing rib for alignment with said at least one tread plate rib when the nosing is centered on the tread plate.

12. A tread element according to claim 1 wherein the nosing is divided longitudinally into a plurality of sections, each section including:

a) an outer longitudinal edge portion having a hook at a lower most end for engagement below the outside surface of the tread plate;

b) inner securing means for securing the nosing to the tread element near an inner longitudinal edge of the nosing; and c) additional securing means between said inner longitudinal edge and outer longitudinal edge portion of the nosing for passing through such tread plate so as to secure the nosing against movement.

13. A tread plate according to claim 12 wherein the tread plate has a projection positioned on the upper surface to engage a recess in one of the sections of the nosing to position the section on the edge of the tread plate.

14. A nosing according to claim 1 wherein the inner securing means comprises a centering projection terminating in a hook for centering the nosing on such tread plate.

15. A nosing according to claim 1 wherein the additional securing means is a threaded connector.

16. A nosing for a movable tread element having a tread plate, said nosing comprising:

a) an outer longitudinal edge portion having a hook at a lowermost end for engagement below an outside edge of the tread plate;

b) a flat inner longitudinal edge for contact with an abutment on such tread plate;

c) a plug between the outer longitudinal edge portion and the inner longitudinal edge for passing through such tread plate and securing the nosing against movement; and d) a centering and holding rib adjacent the plug for engagement in a slot on such tread plate so as to secure the nosing against movement.

17. A movable tread element comprising:

a) a tread plate for receiving a load to be transported, said tread plate having an upper surface, and an outside surface;

b) a nosing mounted on an edge of the tread plate including:

i) an outer longitudinal edge portion having a hook at a lowermost end for engagement below the outside surface of the tread plate;

ii) a centering projection projecting from an inner longitudinal edge of the nosing and having a longitudinal width less than a longitudinal length of the nosing;

iii) a plug between the outer longitudinal edge portion and the inner longitudinal edge; and iv) a centering and holding rib adjacent the plug;

c) said tread plate including a tread plate slot for engagement with the plug, a centering and holding rib slot for engagement with the centering and holding rib, an abutment for contact with the inner longitudinal edge of the nosing and a portion for engagement with the centering projection for securing the nosing against movement; and d) a stop engaged with the plug for securing the plug against vertical movement in the tread plate slot.

18. A nosing for a movable tread element having a tread plate, said nosing comprising:

a) an outer longitudinal edge portion having a hook at a lowermost end;

b) inner securing means for securing the nosing to the tread element near an inner longitudinal edge of the nosing;

c) additional securing means between said inner longitudinal edge and outer longitudinal edge portion of the nosing for passing through such tread plate to secure the nosing against movement; and d) the additional securing means being a plug and a centering and holding rib adjacent the plug, the rib having a longitudinal width less than a longitudinal length of the nosing for engagement with a slot on such tread plate to secure the nosing against movement.

19. A movable tread element for a conveyor comprising:

a) a tread plate for receiving a load to be transported, said tread plate having an upper surface, an underside and a tread plate slot;

b) a nosing mounted on an edge of the tread plate including:

i) an outer longitudinal edge portion having a hook at a lowermost end for engagement with the tread plate underside;

ii) inner securing means for securing the nosing to the tread element near an inner longitudinal edge of the nosing; and iii) additional securing means between said inner longitudinal edge and outer longitudinal edge portion of the nosing for passing through the tread plate slot and securing the nosing against movement;

c) the additional securing means being a plug, and a centering and holding rib adjacent the plug having a longitudinal width less than a longitudinal length of the nosing; and d) the tread plate including at least one centering and holding rib slot extending out from an inner end of the tread plate slot for engagement with the centering and holding rib to secure the nosing against movement.

20. A people mover having a plurality of tread elements, each of said tread elements comprising:

a) a tread plate;

b) a plurality of nosings each secured to an associated marginal edge portion of the tread plate at least in part by interlocking complemental surfaces of the tread plate and nosings;

c) the tread plate and nosing together including means maintaining the nosings in their desired interconnected relationship in the absence of additional securing means;

d) additional securing means securing the nosings to the tread plate; and, e) the additional securing means comprising a plug and a centering and holding rib adjacent the plug for engagement in a slot on such tread plate to secure the nosing against movement.

21. A mover according to claim 20 wherein the and tread plate slot is a centering and holding rib slot extending out from an inner end of the tread plate slot for engagement with the centering and holding rib.

22. A people mover having a plurality of tread elements, each of said tread elements comprising:

a) a tread plate;

b) a plurality of nosings each secured to an associated marginal edge portion of the tread plate at least in part by interlocking complemental surfaces of the tread plate and nosings and by additional securing means;

c) the tread plate and nosing together including means maintaining the nosings in their desired interconnected relationship;

d) the additional securing means comprising a plug which engages a stop on the underside of the tread plate to prevent the plug from moving vertically in the slot; and, e) the plug being composed of plastic and deformed by heat at an end adjacent the underside of the tread plate to prevent the plug from moving vertically in the slot.

23. A tread element for use in a people mover comprising:

a) a step body including an upper tread plate section surrounded by elongate slotted edge portions;

b) a pair of side nosings and front and back nosings surrounding the plate section;

c) each of the nosings having complemental portions complementally disposed in the slotted portions;

d) at least certain of the nosings including overlapping end portions;

e) the coaction of all of said portions maintaining the nosings secured to the body when the tread element is in use;

f) additional securing means secure the nosings to the tread plate; and, g) the additional securing means comprising a plug and a centering and holding rib adjacent the plug for engagement in a slot on such tread plate section to secure the nosing against movement.

24. A tread element for use in a people mover comprising:

a) a step body including an upper tread plate section surrounded by elongate slotted edge portions;

b) a pair of side nosings and front and back nosings surrounding the plate section;

c) each of the nosings having complemental portions complementally disposed in the slotted portions;

d) at least certain of the nosings including overlapping end portions;

e) the coaction of all of said portions maintaining the nosings secured to the body when the tread element is in use;

f) additional securing means securing the nosings to the tread plate, the additional securing means comprising a plug which engages a stop on the underside of the tread plate section to prevent the plug from moving vertically in the slot; and, g) the plug being composed of plastic and deformed by heat at an end adjacent the underside of the tread plate section to prevent the plug from moving vertically in the slot.

25. A tread element for use in a people mover comprising:

a) a step body including an upper tread plate section surrounded by elongate slotted edge portions;

b) a pair of side nosings and front and back nosings surrounding the plate section;

c) each of the nosings having complemental portions complementally disposed in the slotted portions;

d) at least certain of the nosings including overlapping end portions;

e) the coaction of all of said portions maintaining the nosings secured to the body when the tread element is in use; and f) additional securing means securing the nosings to the tread plate, the additional securing means comprising a plug and a centering and holding rib adjacent the plug, the tread plate section including at least one centering and holding rib slot extending out from an inner end of the tread plate slot for engagement with the centering and holding rib to secure the nosing against movement.

* * * * *